US009635463B2

(12) United States Patent
Kawata et al.

(10) Patent No.: US 9,635,463 B2
(45) Date of Patent: Apr. 25, 2017

(54) VIBRATING BODY FOR SPEAKER DEVICE AND SPEAKER DEVICE

(71) Applicants: PIONEER CORPORATION, Kawasaki-shi, Kanagawa (JP); TOHOKU PIONEER CORPORATION, Tendo-shi, Yamagata (JP); MOGAMI DENKI CORPORATION, Mogami-gun, Yamagata (JP)

(72) Inventors: Kazuharu Kawata, Mogami-gun (JP); Haruki Hoshikawa, Mogami-gun (JP); Yoshihiro Sato, Mogami-gun (JP); Takanobu Saito, Tendo (JP)

(73) Assignees: PIONEER CORPORATION, Kanagawa (JP); TOHOKU PIONEER CORPORATION, Tendo, Yamagata (JP); MOGAMI DENKI CORPORATION, Yamagata (JP)

( * ) Notice: Subject to any disclaimer, the term of this patent is extended or adjusted under 35 U.S.C. 154(b) by 0 days.

(21) Appl. No.: 14/781,370

(22) PCT Filed: Apr. 1, 2013

(86) PCT No.: PCT/JP2013/059965

§ 371 (c)(1),
(2) Date: Sep. 30, 2015

(87) PCT Pub. No.: WO2014/162468

PCT Pub. Date: Oct. 9, 2014

(65) Prior Publication Data

US 2016/0037262 A1 Feb. 4, 2016

(51) Int. Cl.

| | |
|---|---|
| ***H04R 7/10*** | (2006.01) |
| ***H04R 7/12*** | (2006.01) |
| *H04R 7/06* | (2006.01) |

(52) U.S. Cl.
CPC ..... *H04R 7/125* (2013.01); *H04R 7/10* (2013.01); *H04R 7/06* (2013.01);
(Continued)

(58) Field of Classification Search
CPC . H04R 7/06; H04R 7/10; H04R 7/125; H04R 2307/023; H04R 2307/025; H04R 2307/029; H04R 2499/11; H04R 2499/13
See application file for complete search history.

(56) References Cited

U.S. PATENT DOCUMENTS 4,308,094 A * 12/1981 Miyoshi ..... D21J 3/12 427/304
4,410,768 A * 10/1983 Nakamura ..... H04R 7/02 381/423
8,385,584 B2 * 2/2013 Wang ..... H04R 7/127 381/423

FOREIGN PATENT DOCUMENTS

JP 01-104815 A 4/1989
JP 5-41294 U 6/1993
(Continued)

OTHER PUBLICATIONS

International Search Report of PCT/JP2013/059965 dated May 28, 2013 [PCT/ISA/210].
(Continued)

*Primary Examiner* — Brian Ensey
(74) *Attorney, Agent, or Firm* — Sughrue Mion, PLLC

(57) ABSTRACT

Provided are a vibrating body for speaker device which prevents interlayer from peeling in advance and includes a large effective vibration area, and a speaker device including this vibrating body for speaker device. The vibrating body for speaker device includes a first interlaced fiber member, and a second interlaced fiber member which overlaps with the first interlaced fiber member, and one of the first interlaced fiber member and the second interlaced fiber member
(Continued)

includes polyvinyl alcohol fibers containing boron, and an outer circumferential portion of the first interlaced fiber member is larger than an outer circumferential portion of the second interlaced fiber member.

14 Claims, 5 Drawing Sheets

(52) U.S. Cl.
CPC .. *H04R 2307/023* (2013.01); *H04R 2307/025* (2013.01); *H04R 2307/029* (2013.01); *H04R 2499/11* (2013.01); *H04R 2499/13* (2013.01)

(56) References Cited

FOREIGN PATENT DOCUMENTS

| | | | |
|---|---|---|---|
| JP | 8-340595 | A | 12/1996 |
| JP | 10-13988 | A | 1/1998 |

OTHER PUBLICATIONS

Written Opinion of PCT/JP2013/059965 dated May 28, 2013 [PCT/ISA/237].
Communication drafted Feb. 6, 2017 issued from the Japan Patent Office in counterpart Application No. 2015-509721.

* cited by examiner

VIBRATING BODY FOR SPEAKER DEVICE AND SPEAKER DEVICE

CROSS REFERENCE TO RELATED APPLICATIONS

This application is a National Stage of International Application No. PCT/JP2013/059965, filed Apr. 1, 2013, the contents of which are incorporated herein by reference in its entirety.

TECHNICAL FIELD

The present invention relates to a vibrating body for speaker device and a speaker device which includes the vibrating body for speaker device.

BACKGROUND ART

A diaphragm formed by a sheet forming method using a single material for the diaphragm and an edge, that is, a so-called a vibrator which includes a fixed edge has been proposed (Patent Literature 1).

The following drawback has been pointed out in Patent Literature 1. In a fixed edge B illustrated in FIG. 9 in Patent Literature 1, an edge portion 12*a* is thinner than a cone diaphragm portion 13*a* by a paper making method to improve a compliance of the edge portion 12*a* as compared to that of the cone diaphragm portion 13*a*. Thus, the edge portion 12*a* needs to be made thinner to further enhance the compliance of the cone diaphragm portion 13*a*, and the fixed edge has therefore drawbacks in that the enhancement of the compliance has made vibration proof weaker, and the fixed edge made of pulp has caused the compliance to be susceptible to outside air environment, particularly to a moisture.

That is, the technique disclosed in Patent Literature 1 has a problem in that the diaphragm and the edge made of a single common material has caused a failure to meet individual needs with respect to the diaphragm and the edge.

CITATION LIST

Patent Literature

Patent Literature 1: JP H05-41294 Y

SUMMARY OF INVENTION

Technical Problem

The present invention addresses the above problem as an example of task. That is, the present invention aims to provide a vibrating body for speaker device in which properties of a diaphragm and an edge have been adjusted, and a speaker device which includes such a vibrating body for speaker device.

Solution to Problem

To achieve the above objectives, a vibrating body for speaker device of the present invention includes: a first interlaced fiber member; and a second interlaced fiber member which overlapping with the first interlaced fiber member, wherein one of the first interlaced fiber member and the second interlaced fiber member includes a polyvinyl alcohol fiber including boron, and an outer circumferential portion of the first interlaced fiber member is larger than an outer circumferential portion of the second interlaced fiber member.

Alternatively, a vibrating body for speaker device includes: a first interlaced fiber member; and a second interlaced fiber member which overlaps with the first interlaced fiber member, wherein one of the first interlaced fiber member and the second interlaced fiber member includes a polyvinyl alcohol fiber including boron, and the first interlaced fiber member configures a bent portion, and the second interfaced fiber member configures a vibration portion.

DESCRIPTION OF EMBODIMENTS

Figure 1A:
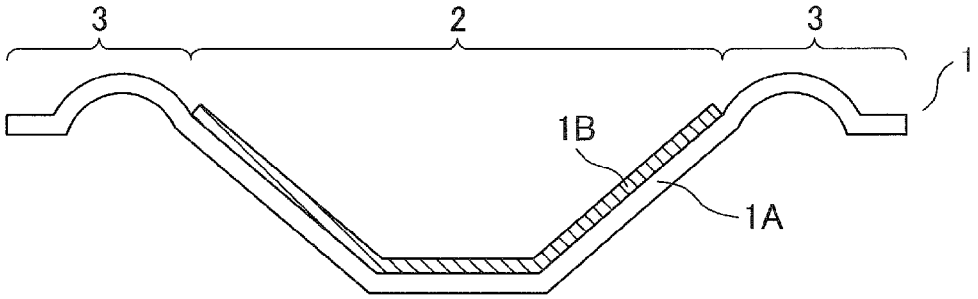
FIGS. 1A and 1B are sectional views according to exemplary vibrating body for speaker devices 1 and 1' according to an embodiment of the present invention.

FIG. 1A illustrates a cross section of an exemplary vibrating body for speaker device 1 according to the present invention as a model.

As described above, the vibrating body for speaker device 1 according to the present invention includes a first interlaced fiber member 1A stacked to a second interlaced fiber member 1B, and one of the first interlaced fiber member 1A and the second interlaced fiber member 1B includes polyvinyl alcohol fibers containing boron, and an outer circumferential portion of the first interlaced fiber member 1A is larger than an outer circumferential portion of the second interlaced fiber member.

The vibrating body for speaker device 1 according to the present invention includes a vibration surface 2, and the vibration surface 2 emits sound waves when assembled in a speaker device.

In a case where, as illustrated in FIG. 1A, the first interlaced fiber member 1A is provided at a front surface side of the vibrating body for speaker device 1, and the second interlaced fiber member 1B is provided at a rear surface side, the first interlaced fiber member 1A configures the vibration surface of the vibrating body for speaker device 2.

Figure 1B:
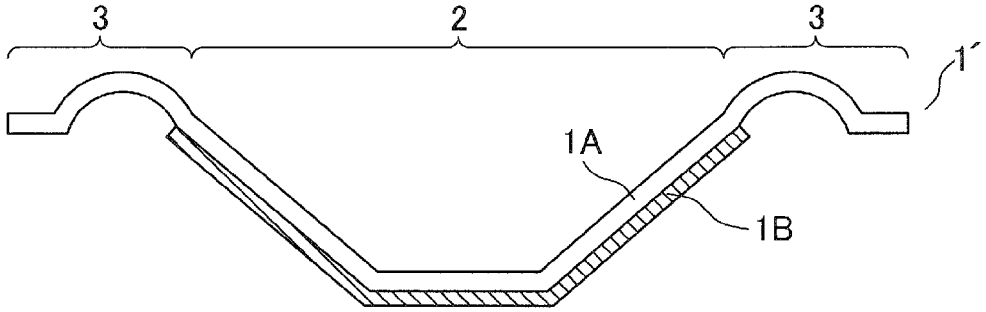

Further, in a case where the first interlaced fiber member 1A is provided at a rear surface side of the vibrating body for speaker device 1' and the second interlaced fiber member 1B is provided at a front surface side as in an exemplary vibrating body for speaker device 1' according to the present invention illustrated in FIG. 1B, the second interlaced fiber member 1B configures the vibration surface of the vibrating body for speaker device.

The vibrating body for speaker device according to the present invention includes a vibration portion 2 including the vibration surface, and a bent portion 3 including the vibration surface. When the vibrating body for speaker device is assembled to the speaker device, the vibration surfaces of these vibration portion 2 and the bent portion 3 emit sound waves. Hence, the speaker device to which the vibrating body for speaker device is assembled possesses a relatively large effective vibration area.

The first interlaced fiber member configures a part of the vibration portion and the bent portion.

The second interlaced fiber member configures a part of the vibration portion.

The outer circumferential portion of the first interlaced fiber member is formed larger than the outer circumferential portion of the second interlaced fiber member. Further, an inner circumferential portion of the first interlaced fiber member is formed smaller than the outer circumferential portion of the second interlaced fiber member.

Furthermore, the inner circumferential portion of the first interlaced fiber member is formed in an substantially equivalent or a smaller size than the inner circumferential portion of the second interlaced fiber member.

That is, the first interlaced fiber member forms a common portion which the vibration portion and the bent portion have in common.

The vibration portion includes two layers. One of these two layers is configured by the first interlaced fiber member, and the other is configured by the second interlaced fiber member. The vibration portion may be formed in a known shape of a diaphragm such as a cone shape or a flat shape.

The bent portion is configured by the first interlaced fiber member. The bent portion is allowed to adopt a known shape of a edge such as a corrugation shape or a bent shape.

The vibration portion may have higher rigidity (Young's modulus) than that of the bent portion. In this case, it is possible to increase a propagation speed of a sound wave emitted from the vibration portion.

A stacking structure including the first interlaced fiber member and the second interlaced fiber member in the vibration portion enables an increase in rigidity. Further, an increase of the rigidity of the second interlaced fiber member as compared to that of the first interlaced fiber member enables an increase of the rigidity of the vibration portion. Specifically, an increase of the density of the second interlaced fiber member as compared to the density of the first interlaced fiber member, a configuration of the second interlaced fiber member with fibers having relatively higher rigidity, and the like can be exemplified. The fibers having relatively higher rigidity can be fibers of a relatively higher Young's modulus or relatively longer fibers, and so on. The fibers of the relatively higher Young's modulus can be polyvinyl alcohol fibers containing boron for example, as described below. Further, by making the lengths of fibers relatively longer, the fibers become to possess relatively higher flexural rigidity.

The bent portion may be made to have lower rigidity (Young's modulus) than that of the vibration portion. In this case, the vibration portion can be adequately supported with respect to a frame possessed by the speaker device which will be described below.

The bent portion can be made by, for example, a single layer configured by the first interlaced fiber member to have lower rigidity with respect to the vibration portion including the layer configured by this first interlaced fiber member. Further, the density of the second interlaced fiber member configuring the bent portion can be made relatively lower so that the second interlaced fiber member has relatively lower rigidity. Lowering the rigidity of the bent portion as such improves the compliance of vibration made at the vibration portion. Hence, the vibration portion can vibrate closely following an electrical signal inputted to the voice coil.

When the speaker device (described below) which includes the vibrating body for speaker device according to the present invention is actuated, bending movement is repeatedly made at the bent portion since the bent portion supports the vibration portion with respect to the frame of the speaker device. Hence, a stress is kept working on a boundary between the bent portion and the vibration portion, and a tear is therefore produced in some cases. Hence, by making relatively longer the lengths of the fibers in the first interlaced fiber member which configures the bent portion and the vibration portion, an occurrence of a tear can be prevented.

The lengths of the fibers of the first interlaced fiber member may be made longer than the lengths of the fibers of the second interlaced fiber member.

One of the first interlaced fiber member and the second interlaced fiber member configuring the vibrating body for speaker device according to the present invention includes polyvinyl alcohol fibers containing boron.

The vibration portion in the speaker diaphragm adopts a structure in which the first interlaced fiber member and the second interlaced fiber member are stacked.

In a case when forming such a stacking structure, the first interlaced fiber member which is a sheet forming member formed by sheet forming is overlapped with the second interlaced fiber member which is a sheet forming member individually, and they are heated and pressurized by using two molds which sandwich these overlapped first interlaced fiber member and second interlaced fiber member between the two molds. In this case, adhension between the first interlaced fiber member and the second interlaced fiber member is weak, and therefore the first interlaced fiber member and the second interlaced fiber member are peeled after being heated and pressurized in some cases. However, since one of the first interlaced fiber member and the second interlaced fiber member includes polyvinyl alcohol fibers containing boron, it is possible to prevent the first interlaced fiber member and the second interlaced fiber member from being peeled off. Further, this polyvinyl alcohol fibers adhere to the mold when polyvinyl alcohol fibers which can be dissolved in hot water of about 60° C. are used, and the first interlaced fiber member and the second interlaced fiber member become hardly peeled off from the molds and thereby, a productivity thereof is lowered in some cases. The present invention improves mold release characteristics with respect to a mold by using the polyvinyl alcohol fibers containing boron, and the productivity is improved.

One, or two or more fibers selected from natural fibers, recycled fibers, chemical fibers, synthetic fibers, organic fibers and inorganic fibers can be used for the vibrating body for speaker device according to an embodiment of the present invention.

The natural fibers can be wood pulp fibers, non-wood pulp fibers, plant fibers and animal fibers. The wood pulp fibers can be sulfite pulp and craft pulp. The non-wood pulp fibers can be bamboos and straws. The plant fibers can be Manila hemp and cotton. The animal fibers can be silk and wool. The chemical fibers and the synthetic fibers can be fibers made of rayon, nylon, vinylon, polyester and acrylic. The organic fibers can be fibers made of graphite. The inorganic fibers can be inorganic fibers made of silicon carbide, glass fibers, carbon fibers, ceramic fibers and mineral fibers made of basalt.

In this regard, synthetic fibers used for the interlaced fiber members of the vibrating body for speaker device can be polyvinyl alcohol fibers containing boron. When the polyvinyl alcohol fibers which can be dissolved in hot water at 60° C. are used for the interlaced fiber members of the vibrating body for speaker device, and when a sheet forming member (e.g., an interlaced fiber member containing water) obtained by sheet forming is dried, there is a problem that a mold used for drying changes water to hot water, and this hot water dissolves the polyvinyl alcohol fibers, the dissolved fibers adheres to the mold, and thus it becomes hardly possible to peel off the dried sheet forming member and the productivity is lowered. However, by using the polyvinyl alcohol fibers containing boron, it is possible to improve mold release characteristics with respect to molds and the productivity is improved.

Further, the polyvinyl alcohol fibers containing boron can be fibers having a composition consisted of polyvinyl alcohol high molecular compounds containing boric acid, and fibers consisted of polyvinyl alcohol high molecular compounds provided by a boron crosslink which is known from Patent Literatures 4 and 5. Here, the formula (1) and the formula (2) represent structures of a boron crosslink portion in two examples of polyvinyl alcohol high molecular compounds provided by the boron crosslink. Further, the formula (3) represents another example of a polyvinyl alcohol high molecular compound provided by the boron crosslink.

[Chemical Formula 1]

(1)

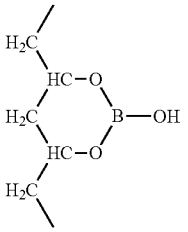

[Chemical Formula 2]

(2)

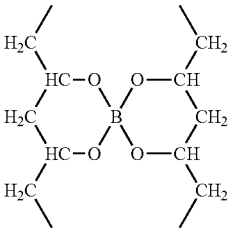

[Chemical Formula 3]

(3)

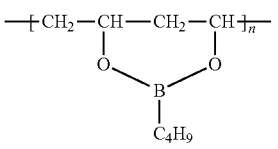

A boron crosslink structure of the polyvinyl alcohol high molecular compound containing boron crosslink is formed by doping polyvinyl alcohol with boric acid, borate or boronic acid. The polyvinyl alcohol described herein is a polymer which contains 10 mol % of vinyl alcohol units or more, preferably, 30 mol % or more and, more preferably 50 mol % or more, and is generally obtained by hydrolyzing (saponification or alcoholysis) a homopolymer or a copolymer of vinyl ester or vinyl ether. In this regard, vinyl ester is typically vinyl acetate, and additionally includes vinyl formate, vinyl propionate, vinyl pivalate, vinyl barein acid, vinyl caprate and vinyl benzoate. Vinyl ether includes t-butyl vinyl ether and benzyl vinyl ether. Further, polyvinyl alcohol may contain the following monomer unit. These monomer units include olefins such as propylene, 1-butene and isobutene except for ethylene; unsaturated acids such as acrylic acid, methacrylic acid, maleic acid, itaconic acid and maleic anhydride, their salts or mono or dialkyl esters of carbon numbers 1 to 18; acrylamides such as acrylamide, N-alkyl acrylamide of carbon numbers 1 to 18, N,N-dimethylacrylamide, 2-acrylamido propane sulfonic acid, their salts, or a quaternary salt thereof; methacrylamides such as methacrylamide, N-alkyl-methacrylamide of carbon numbers 1 to 18, N,N-dimethyl methacrylamide, 2-methacrylamide propane sulfonic acid, their salts, methacrylamide propyl dimethylamine, its salt or a quaternary salt thereof; N-vinylamides such as N-vinylpyrrolidone, N-vinylformamide, and N-vinyl acetamide; allyl compounds such as allyl acetate, allyl alcohol and 8-hydroxy-1-octene, vinyl cyanides such as acrylonitrile and methacrylonitrile, and vinyl ethers such as alkyl vinyl ethers of carbon numbers 1 to 18, alkoxyalkyl vinyl ether; vinyl halides such as vinyl chloride and vinylidene chloride, and vinyl fluoride and vinylidene fluoride; and dimethylallyl alcohol and the vinyl ketone.

Further, a blending amount of fibers of the first interlaced fiber member which configures the vibrating body for speaker device includes that a blending amount of the polyvinyl alcohol fibers containing boron is 30 wt % and the blending amount of other fibers (e.g., natural fibers) other than the polyvinyl alcohol fibers is 70 wt %. Furthermore, a blending amount of fibers of the second interlaced fiber member which configures the vibrating body for speaker device includes that a blending amount of the polyvinyl alcohol fibers containing boron is 10 wt % and the blending amount of other fibers (e.g., natural fibers) other than the polyvinyl alcohol fibers is 90 wt %.

The blending amount of the polyvinyl alcohol fibers containing boron is preferably relatively decreased in order to relatively lower rigidity of the first interlaced fiber member. Hence, the blending amount of the polyvinyl alcohol fibers containing boron is preferably smaller than the blending amount of other fibers.

The blending amount of the polyvinyl alcohol fibers containing boron is preferably relatively increased in order to relatively increase rigidity of the second interlaced fiber member. Meanwhile, the blending amount of the polyvinyl alcohol fibers containing boron is preferably smaller than the blending amount of other fibers from the viewpoint that the rigidity does not become excessively high.

The water melting temperature of the polyvinyl alcohol fibers containing boron is greater than 80° C. By using these fibers, it is possible to prevent the fibers from being melted by hot water and adhering to the mold and prevent productivity from lowering due to adhesion of the fibers to the mold when the speaker diaphragm is formed by using the mold.

Further, when the polyvinyl alcohol fibers containing boron are crimped fibers, interlacing points of the fibers increase, so that it is possible to easily cause friction between fibers and improve internal loss of the speaker diaphragm. Further, an increase of interlacing points of the fibers enables an increase of the Young's modulus of the speaker diaphragm.

Figure 2:
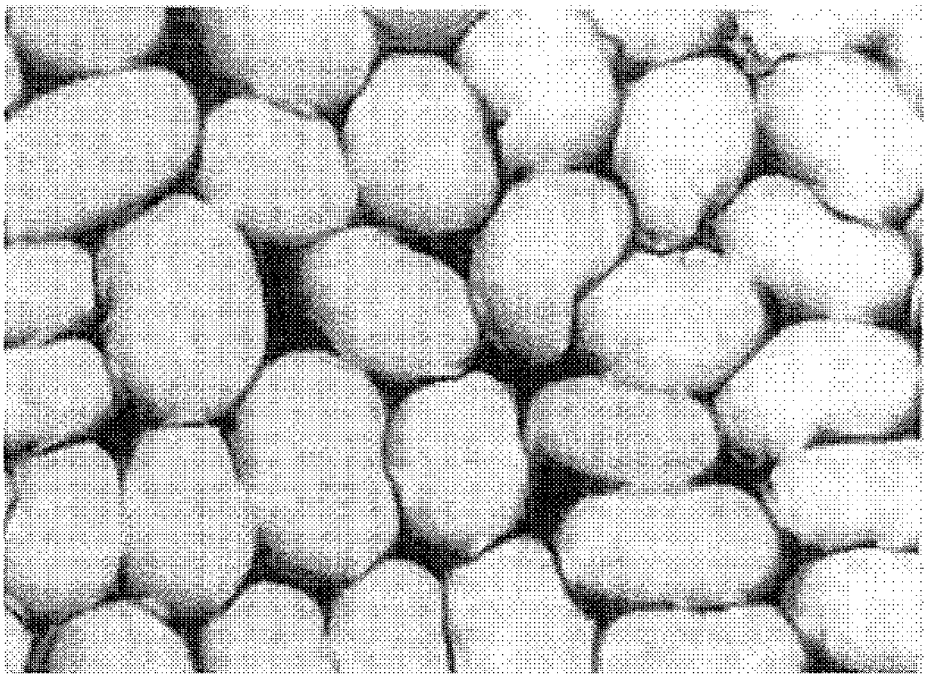
FIG. 2 is a sectional view of a vibrating body for speaker device 1" according to a modified example of the present invention.

Further, when cross-sectional shapes of the interlaced fibers are circular or elliptic, it is possible to prevent fibers from being split (e.g., split in a radial (radius) direction) in advance. FIG. 2 illustrates an electron micrography showing a cross section of a fiber bundle which is an example of polyvinyl alcohol fibers containing boron used in the present invention.

Figure 3:
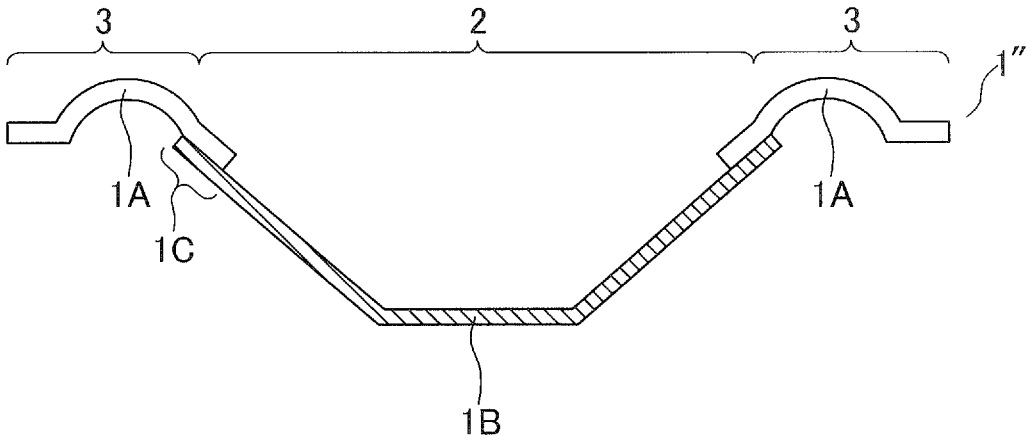
FIG. 3 illustrates an electron micrography showing a cross section of a fiber bundle which is an example of polyvinyl alcohol fibers containing boron used in the present invention.

In the above embodiment, the first interlaced fiber member configures part of the vibration portion and the bent portion, and the second interlaced fiber member configures part of the vibration portion. The outer circumferential portion of the first interlaced fiber member is formed larger than the outer circumferential portion of the second interlaced fiber member, and the inner circumferential portion of the first interlaced fiber member is formed smaller than the outer circumferential portion of the second interlaced fiber member. The present invention is not limited to this configuration, and the bent portion may be configured by the first interlaced fiber member 1A and the vibration portion may be configured by the second interlaced fiber member as in another exemplary vibrating body for speaker device 1" according to the present invention illustrated in FIG. 3. In this case, the outer circumferential portion of the first interlaced fiber member 1A is formed larger than the outer circumferential portion of the second interlaced fiber member 1B, and the inner circumferential portion of the first interlaced fiber member 1A is formed smaller than the outer circumferential portion of the second interlaced fiber member 1B.

Further, the inner circumferential portion of the first interlaced fiber member 1A is formed larger than the inner circumferential portion of the second interlaced fiber member 1B. The inner circumferential portion of the bent portion 3 configured by the first interlaced fiber member 1A overlaps the outer circumferential portion of the vibration portion 2 configured by the second interlaced fiber member 1B, and these bent portion 3 and vibration portion 2 are jointed. Hence, the vibrating body for speaker device includes an overlapping portion at which the first interlaced fiber member 1A and the second interlaced fiber member 1B overlap with each other. In the example in FIG. 3, at an overlapping portion 1C, the first interlaced fiber member 1A is provided at the front surface side of the vibrating body for speaker device and the second interlaced fiber member 1B is provided at the rear surface side of the vibrating body for speaker device. However, the present invention is not limited to this, and the second interlaced fiber member 2B may be provided at the front surface side of the vibrating body for speaker device and the first interlaced fiber member 1A may be provided at the rear surface side of the vibrating body for speaker device. Part of the first interlaced fiber member 1A or part of the second interlaced fiber member 1B at this overlapping portion includes the above polyvinyl alcohol fibers containing boron. Further, each of the first interlaced fiber member 1A and the second interlaced fiber member 1B includes the vibration surface.

The vibrating body for speaker device employs such a configuration, so that the bent portion is substantially configured by the first interlaced fiber member and the vibration portion is substantially configured by the second interlaced fiber member. For example, when the Young's modulus of the first interlaced fiber member is made smaller than the Young's modulus of the second interlaced fiber member to make the bent portion flexible, the second interlaced fiber member is not stacked on the first interlaced fiber member, so that the bent portion has desired flexibility and has improved compliance with vibration of the vibration portion. In other words, when the Young's modulus of the second interlaced fiber member is greater than the Young's modulus of the first interlaced fiber member, the first interlaced fiber member is not stacked on the second fiber interlaced fiber member, so that the vibration portion has a relatively higher Young's modulus than that of the bent potion and has an improved propagation speed. Further, the stacking portion is a joint portion of the vibration portion and the bent portion, so that it is possible to reduce the weight of the vibrating body for speaker device. Meanwhile, in order to joint the bent portion and the vibration portion, the interlaced fiber member of one of the bent portion and the vibration portion may include polyvinyl alcohol fibers containing boron, or, in order to improve the Young's modulus of the vibration portion concurrently with the above, the second interlaced fiber member which configures the vibration portion may include polyvinyl alcohol fibers containing boron.

Figure 4:
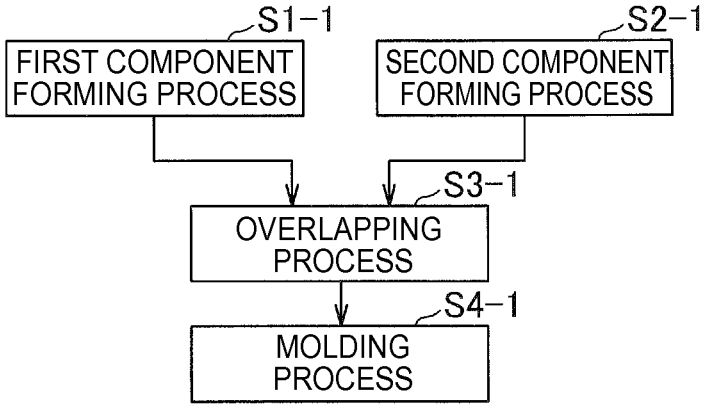
FIG. 4 is a flowchart of a method of manufacturing the exemplary vibrating body for speaker device 1 according to the example of the present invention.

FIG. 4 illustrates a flowchart of a method of manufacturing the speaker diaphragm 1" illustrated in FIG. 1A as an example of a method of manufacturing the vibrating body for speaker device according to the present invention.

In step S1-1, a first component, that is, the first interlaced fiber member which is a sheet forming member including the bent portion is formed by a sheet forming method by using pulp, and, at the same time as step S1-1, or before or after this step S1-1, in step S2-1, the first interlaced fiber member which is a sheet forming member without the bent portion is formed as a second component by using polyvinyl alcohol fibers containing boron, and pulp by a sheet forming method.

Next, in step S3-1, these interlaced fiber members are overlapped with each other, and heated, pressurized and integrated in step S4-1 as a molding process.

Figure 5:
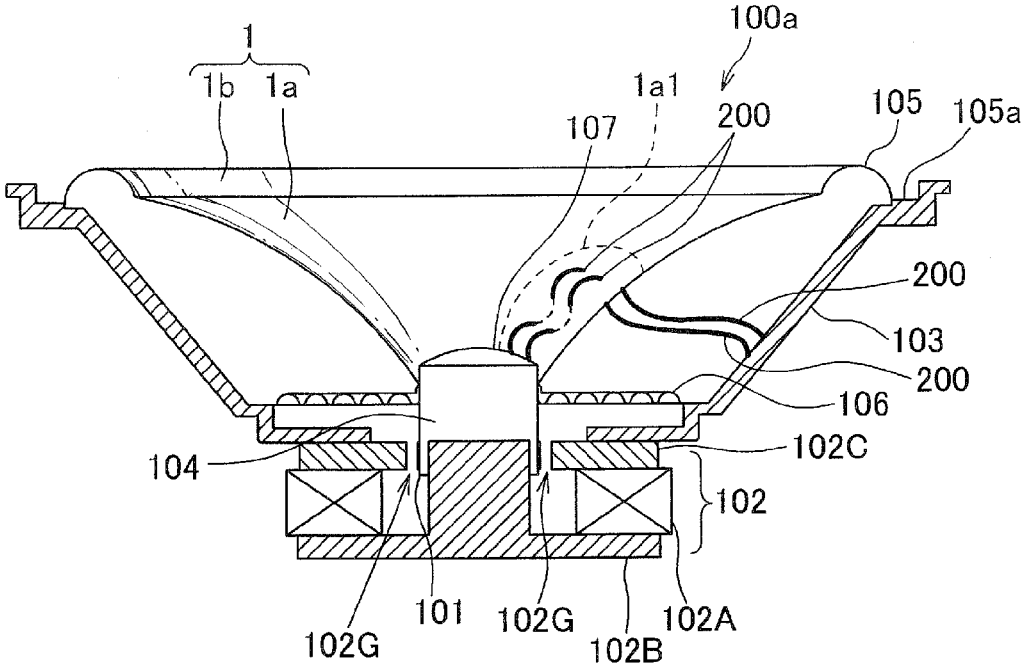
FIG. 5 is a model view illustrating an exemplary speaker device 100 according to the present invention.

FIG. 5 illustrates an exemplary speaker device 100*a* which includes the vibrating body for speaker device according to the present invention.

The speaker device 100*a* includes a frame 103, the vibrating body for speaker device 1 according to the present invention which includes a vibration portion 1*a* and a bent portion 1*b*, a center cap 107, a bent portion 105, speaker leads (tinsel wires) 200, a damper 106, a voice coil supporting portion 104, a voice coil 101 which is supported by the voice coil supporting portion, and a magnetic circuit 102. The magnetic circuit 102 includes a magnet 102A, a yoke 102B, a plate 102C and a magnetic gap 102G on which the voice coil 101*b* is arranged.

In this speaker device 100*a*, the speaker leads 200 as audio signal supply lines which supply audio signals to the voice coil 101 are arranged between the top surface and the back surface of the speaker diaphragm 1*a* while threading the vibration portion 1*a* of the vibrating body for speaker device.

The vibration portion 1*a* is supported by the bent portion 1*b* with respect to the frame 103. In addition, an outer circumferential portion 105*a* of the bent portion 1*b* is jointed to the frame 103. The vibration portion 1*a*, the bent portion 105 and the center cap 107 compose the vibration surface that emits a sound wave.

Figure 6A:
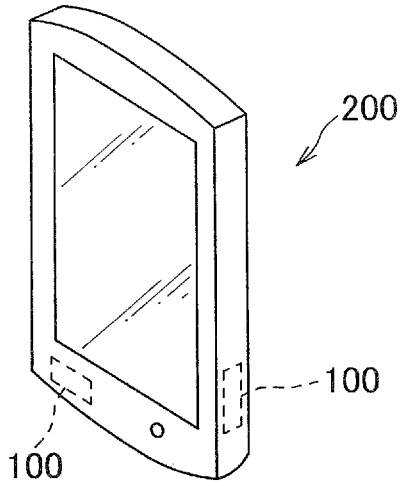
FIGS. 6A to 6C are model views illustrating a mounting example and an installation example of the exemplary speaker device 100 according to the present invention.
Figure 6B:
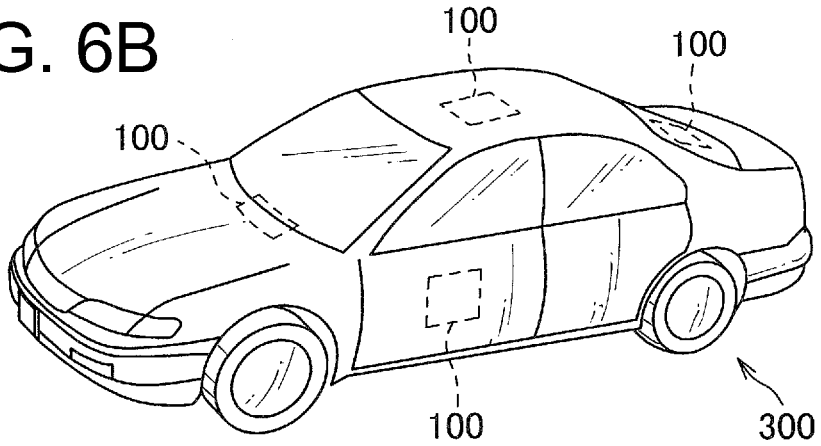
Figure 6C:
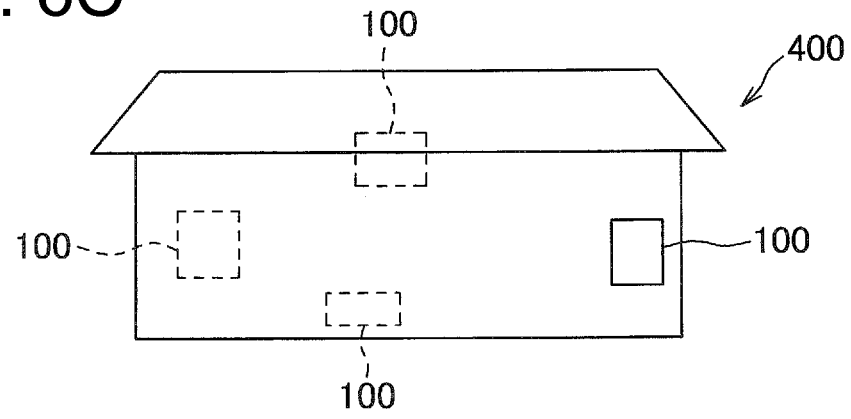

FIGS. 6A to 6C are explanatory views illustrating an electronic device, a car and a building at which the speaker device including the speaker diaphragm according to the embodiment of the present invention is mounted or installed. The speaker device 100 according to the embodiment of the present invention can be adequately mounted on an electronic device 200 and a car 300 as illustrated in FIGS. 6A and 6B, or can be adequately installed in a building 400 such as a house.

The electronic device 200 illustrated in FIG. 6A is a small electronic device such as a mobile telephone or a mobile information terminal, or an electronic device such as a flat panel display or an audio device, and the speaker 100 can be mounted in these housings. At a rear portion, a front portion, a door portion or a ceiling portion in a vehicle compartment of the car 300 illustrated in FIG. 6B, the speaker device 100 can be mounted. At an inner wall portion, a ceiling portion, a floor portion or an outer wall portion of the building 400 illustrated in FIG. 6C, the speaker device 100 can be installed.

The preferred embodiment of the present invention has been described above. However, the vibrating body for speaker device according to the present invention and the speaker device are not limited to the configuration of the above embodiment.

One of ordinary skill in the art can optionally modify the vibrating body for speaker device according to the present invention and the speaker device according to conventionally known knowledge. Insofar as the configurations of the vibrating body for speaker device according to the present invention and the speaker device are employed, this modification is included in the scope of the present invention.

REFERENCE SIGNS LIST

100 Exemplary speaker device according present invention
1 Vibrating body for speaker device
1*a* Vibration portion of vibrating body for speaker device
1*b* Bent portion of vibrating body for speaker device
1A First interlaced fiber member
1B Second interlaced fiber member
101 Voice coil
102 Magnetic circuit
102A Permanent magnet
102B, 102C Ball piece
102G Gap portion
103 Frame
104 Cylindrical portion
105 Edge
106 Damper
107 Center cap
200 Speaker lead

The invention claimed is:

1. A vibrating body for speaker device comprising:

a first interlaced fiber member; and a second interlaced fiber member overlapping with the first interlaced fiber member, wherein one of the first interlaced fiber member and the second interlaced fiber member includes a polyvinyl alcohol fiber containing boron, wherein the first interlaced fiber member includes a bent portion and a first vibration portion, wherein the second interlaced fiber member includes a second vibration portion, and wherein fibers of the first interlaced fiber member are longer than fibers of the second interlaced fiber member.

2. The vibrating body for speaker device according to claim 1, wherein an inner circumferential portion of the first interlaced fiber member and an outer circumferential portion of the second interlaced fiber member are connected.

3. The vibrating body for speaker device according to claim 2, wherein the first interlaced fiber member includes an annular shape.

4. The vibrating body for speaker device according to claim 1, wherein the polyvinyl alcohol fiber of the first interlaced fiber member including boron are longer than the polyvinyl alcohol fiber of the second interlaced fiber member including boron.

5. The vibrating body for speaker device according to claim 4, wherein the bent portion is arranged between an outer circumferential portion of the first interlaced fiber member and an outer circumferential portion of the second interlaced fiber member.

6. The vibrating body for speaker device according to claim 1, wherein a water melting temperature of the polyvinyl alcohol fiber including boron is higher than 80° C.

7. The vibrating body for speaker device according to claim 2, wherein a water melting temperature of the polyvinyl alcohol fiber including boron is higher than 80° C.

8. The vibrating body for speaker device according to claim 1, wherein the polyvinyl alcohol fiber is a crimped fiber.

9. The vibrating body for speaker device according to claim 2, wherein the polyvinyl alcohol fiber is a crimped fiber.

10. The vibrating body for speaker device according to claim 1, wherein a cross-sectional shape of the polyvinyl alcohol fiber is formed in a circular or in an elliptic shape.

11. The vibrating body for speaker device according to claim 2, wherein a cross-sectional shape of the polyvinyl alcohol fiber is formed in a circular or in an elliptic shape.

12. A speaker device comprising the vibrating body for speaker device according to claim 1.

13. An electronic device comprising the speaker device according to claim 12.

14. The vibrating body for speaker device according to claim 1, wherein the first interlaced fiber member and the second interlaced fiber member includes a polyvinyl alcohol fiber containing boron.

* * * * *